US005851936A

United States Patent [19]

Marshall

[11] Patent Number: 5,851,936

[45] Date of Patent: Dec. 22, 1998

[54] ELONGATION FOR FLASH SPUN PRODUCTS

[75] Inventor: Larry Ray Marshall, Chesterfield, Va.

[73] Assignee: E. I. du Pont de Nemours and Company, Wilmington, Del.

[21] Appl. No.: 825,266

[22] Filed: Mar. 27, 1997

Related U.S. Application Data

[63] Continuation-in-part of Ser. No. 699,281, Aug. 19, 1996, abandoned.

[51] Int. Cl.[6] ..... D01D 5/11

[52] U.S. Cl. ..... 442/334; 264/205; 428/171

[58] Field of Search ..... 442/334; 428/171; 264/205

[56] References Cited

U.S. PATENT DOCUMENTS

| | | | |
|---|---|---|---|
| 3,227,794 | 1/1966 | Anderson et al. | 264/205 |
| 3,774,387 | 11/1973 | Woodell | 57/140 R |
| 3,860,369 | 1/1975 | Brethauer et al. | 425/253 |
| 4,554,207 | 11/1985 | Lee | 428/288 |
| 4,927,586 | 5/1990 | Smook et al. | 264/185 |
| 5,023,130 | 6/1991 | Simpson et al. | 428/227 |
| 5,250,237 | 10/1993 | Shin | 264/13 |

FOREIGN PATENT DOCUMENTS

| | | |
|---|---|---|
| 3826621 | 2/1990 | Germany . |

*Primary Examiner*—James J. Bell

[57] ABSTRACT

This invention relates to improved elongation properties for flash-spun plexifilamentary film-fibrils. The technique for obtaining the improved properties is to increase the length to diameter ratio of the spin orifice and to reduce the ratio of polymer in the spin solution.

25 Claims, 2 Drawing Sheets

ELONGATION FOR FLASH SPUN PRODUCTS

RELATED APPLICATIONS

This patent application is a continuation in part application of U.S. patent application Ser. No. 08/699,281, filed 19 Aug. 1996 now abandoned.

FIELD OF THE INVENTION

This invention relates to flash-spun plexifilaments and particularly to nonwoven flash-spun sheets or fabrics made with flash-spun plexifilaments.

BACKGROUND OF THE INVENTION

E. I. du Pont de Nemours and Company (DuPont) has been making Tyvek® spunbonded olefin for a number of years. Tyvek® spun bonded olefin is used as a fabric for garments, especially for use in protective apparel for chemical or hazardous exposure, as an air infiltration barrier for construction applications, as medical packaging, and also for envelopes such as overnight express envelopes. New applications for Tyvek® spunbonded olefin are always being considered and developed.

The properties of Tyvek® spunbonded olefin, such as high strength, low basis weight, high barrier, low cost, high opacity, porosity, the ability to accept printing with vivid results and many other qualities, make it quite unique. No other product has been commercially available with a combination of properties comparable to Tyvek® spunbonded olefin. However, DuPont is always looking to improve its product offerings and it is quite desirable to push the properties of Tyvek® spunbonded olefin beyond its current limits.

One particular property that would be desirable to improve is elongation to break or "break elongation". Break elongation is the percentage the sheet material stretches before it breaks. It is desirable to increase break elongation to provide the nonwoven sheets with some give prior to breaking. For example, as a garment for protective apparel, the wearer may stretch his arm outwards from the body and then bend it at the elbow. If the garment is at all tight fitting, the fabric of sleeve, under this circumstance, would be stretched. However, it is preferred that the fabric give or yield rather than rip or break. High break elongation also tends to increase another related property called toughness. In general toughness is a measure of a combination of tensile strength and break elongation. Materials that have high toughness tend to have substantial tensile strength with the ability to stretch before failure.

Thus, it is an object of the present invention to improve the elongation of flash-spun nonwoven fabrics while maintaining its other properties.

SUMMARY OF THE INVENTION

The above and other properties of the present invention are achieved by a sheet material having an opacity greater than 85%, a basis weight greater than 30 g/m$^2$ but less than 100 g/m$^2$, a Spencer puncture greater than 20 in-lb/in$^2$ and an average break elongation of greater than about 30%.

The invention further relates to a process for flash spinning polymer and forming sheet material therefrom, the improvement comprising mixing the polymer in a hydrocarbon spin agent at a ratio of less than about 16% polymer, and emitting the polymer solution through a spin orifice at a temperature of at least about 180° C., wherein the spin orifice has a length to diameter ratio of at least 2.0.

The invention further relates to an improvement to flash-spun fabrics by spinning a polymer solution through a spin orifice having a length to diameter ratio of at least 2.0% and including an inline mixer in a letdown process prior to the spinning orifice.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily to scale.

DETAILED DESCRIPTION OF THE PREFERRED EMBODIMENT

Figure 1:
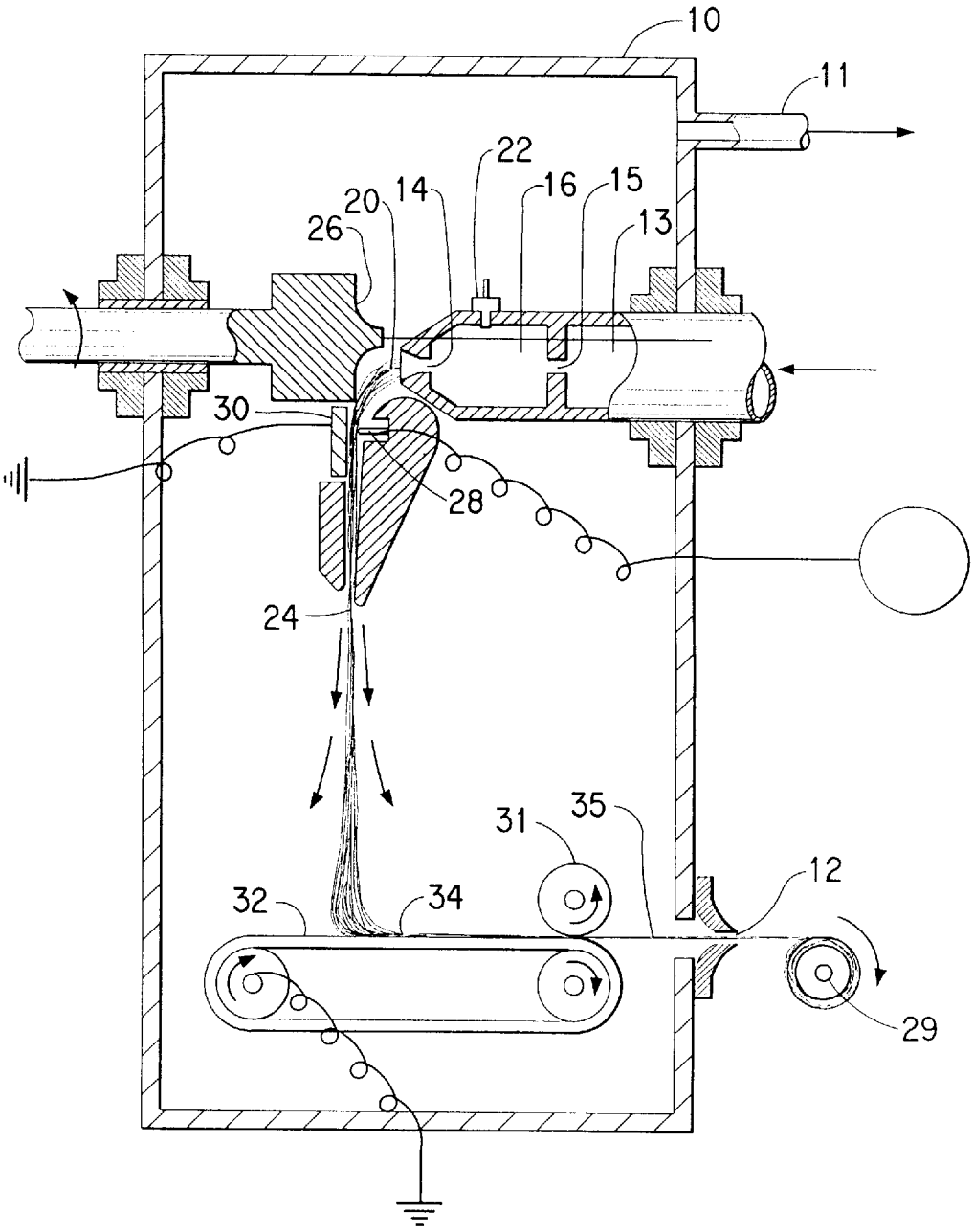
FIG. 1 (PRIOR ART)
FIG. 1 a schematic cross sectional view of a spin cell illustrating the basic process for making flash-spun nonwoven products.

The basic flash spinning process for making flash-spun nonwoven products, and specifically Tyvek® spunbonded olefin, was first developed more than twenty-five years ago and put into commercial use by DuPont. The basic process is illustrated in FIG. 1 and is similar to that disclosed in U.S. Pat. No. 3,860,369 to Brethauer et al., which is hereby incorporated by reference. The flash-spinning process is normally conducted in a chamber 10, sometimes referred to as a spin cell, which has an exhaust port 11 for exhausting the spin cell atmosphere to a spin agent recovery system and an opening 12 through which non-woven sheet material produced in the process is removed.

Figure 2:
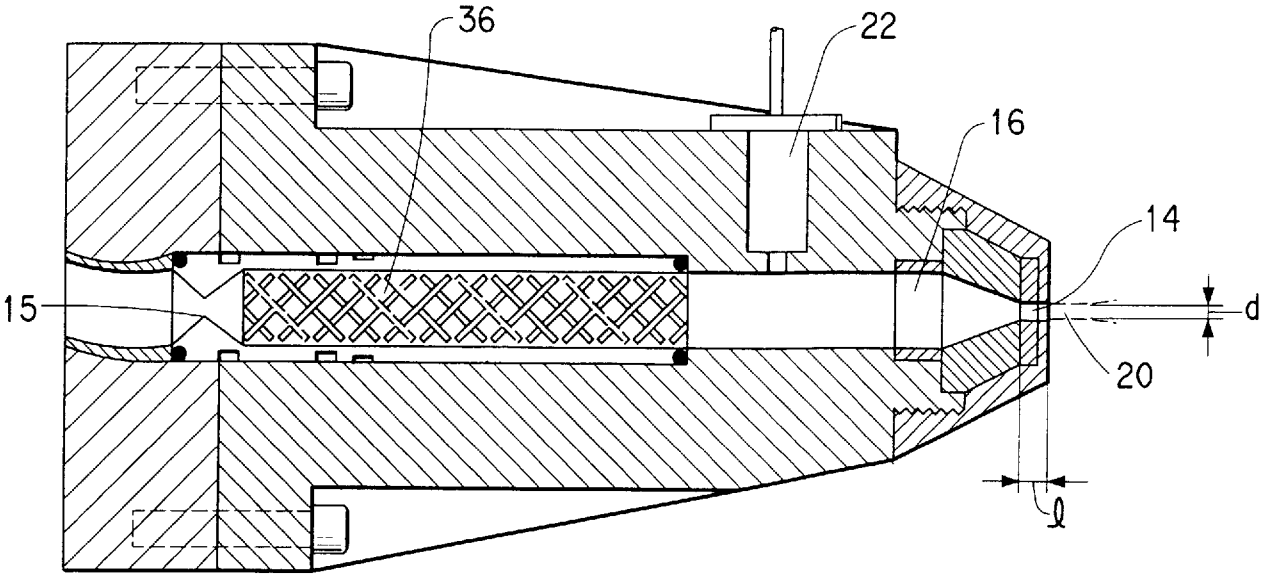
FIG. 2 is an enlarged cross sectional view of the spinning equipment for flash spinning fiber.

A solution of polymer and spin agent is provided through a pressurized supply conduit 13 to a letdown orifice 15 and into a letdown chamber 16. The pressure reduction in the letdown chamber 16 precipitates the nucleation of polymer from a polymer solution, as is disclosed in U.S. Pat. No. 3,227,794 to Anderson et al. One option for the process is to include an inline static mixer 36 (see FIG. 2) in the letdown chamber 16. A suitable mixer is available from Koch Engineering Company of Wichita, Kans. as Model SMX. A pressure sensor 22 may be provided for monitoring the pressure in the chamber 16. The polymer mixture in chamber 16 next passes through spin orifice 14. It is believed that passage of the pressurized polymer and spin agent from the letdown chamber 16 into the spin orifice 14 generates an extensional flow near the approach of the orifice that helps to orient the polymer into long polymer molecules. As the polymer passes through the spin orifice, the polymer molecules are further stretched and aligned. When polymer and spin agent discharge from the spin orifice 14, the spin agent rapidly expands as a gas and leaves behind fibrillated plexifilamentary film-fibrils. The gas exits the chamber 10 through the exhaust port 11. The spin agent's expansion during flashing accelerates the polymer so as to further stretch the polymer molecules just as the film-fibrils are being formed and the polymer is being cooled by the adiabatic expansion. The quenching of the polymer freezes the linear orientation of the polymer molecule chains in place, which contributes to the strength of the resulting flash-spun plexifilamentary polymer structure.

The polymer strand 20 discharged from the spin orifice 14 is conventionally directed against a rotating lobed deflector baffle 26. The rotating baffle 26 spreads the strand 20 into a more planar web structure 24 that the baffle alternately directs to the left and right. As the spread web descends from the baffle, the web is passed through an electric corona generated between an ion gun 28 and a target plate 30. The corona charges the web so as to hold it in a spread open configuration as the web 24 descends to a moving belt 32 where the web forms a batt 34. The belt is grounded to help insure proper pinning of the charged web 24 on the belt. The fibrous batt 34 is passed under a roller 31 that compresses the batt into a sheet 35 formed with plexifilamentary film-fibril networks oriented in an overlapping multi-directional configuration. The sheet 35 exits the spin chamber 10 through the outlet 12 before being collected on a sheet collection roll 29.

The sheet 35 is subsequently run through a finishing line which treats and bonds the material appropriate for its end use. For example, a significant part of the Tyvek product line is hard product which is pressed on a smooth heated bonder roll. The hard product has the feel of slick paper and is used commonly in overnight mailing envelopes and for air infiltration barriers in construction applications. By this bonding process, both sides of the sheet are subjected to generally uniform, full surface contact thermal bonding. For apparel, the sheet 35 is typically point bonded to have a softer, fabric like feel. The intent is to provide closely spaced bonding points with unbonded fiber therebetween in an aesthetically pleasing pattern. DuPont uses one particular point bonding pattern where one side of the sheet is contacted by a quite undulated surface thermal bonder providing portions having very slight thermal bonding while other portions are more clearly subjected to the bonding. After the sheet is bonded, it is often subjected to mechanical softening to remove some harshness that may have been introduced during the bonding.

Referring again to FIG. 2, one aspect of the present invention relates to the size and shape of the spin orifice 14. The spin orifice 14 may be characterized as having a length to diameter ratio. The diameter of the spin orifice 14 is indicated by the letter "d". The length of the spin orifice 14 is indicated in the figure by the letter "l" and relates to the length of the spin orifice which has the diameter "d". The conventional spin orifice has a length to diameter ratio of 0.9. Thus the length of the orifice is slightly less than its diameter. It has been found that a spin orifice that is much longer than its diameter creates webs that when laid down into fabric sheets have much higher elongation properties. This will be further discussed in relation to examples below.

The foregoing described process for flash spinning and finishing has been in commercial use for a number of years. Until recently, the only commercial facilities for flash spinning were based on the use of a chlorofluorocarbon (CFC) spin agent, trichlorofluoromethane (FREON®-11). Considering the complexity of a flash spinning manufacturing facility and the multitude of considerations for operating such a facility, Freon-11 would, until recently, have been the only logical choice for a spin agent because DuPont has proved that it will work. However, according to present law, it CFC's must be phased out of industrial use to protect the ozone layer.

With the present need to eliminate CFC's from industrial use, DuPont has been working extensively on revising the process for making Tyvek® spunbonded olefin to use a non-CFC, non-ozone depleting spin agent. After much testing and consideration, the process has necessarily been redeveloped around a hydrocarbon spin agent, namely pentane. The transition has required numerous and extensive changes to the process and has required that a completely new facility be built to implement the new spin agent. Many of the developments in the project have been the subject of many patents and patent applications. As part of the development and transition process (which is still ongoing), full capability test facilities were built to find optimal operating regimes for the numerous aspects and parameters of flash spinning.

Initially, the operating ranges for the letdown pressure, solution temperature, and polymer ratio as well as other operating parameters were developed in the lab based on web properties alone. With an eye to seek improved manufacturing and product performance, broad testing was permitted in the test facilities. Previous tests in the commercial facilities had proven that the system is prone to significant problems with large scale coating of the equipment when operating parameters are varied even slightly. When the equipment becomes coated, it must be disassembled, aggressively cleaned and reassembled. In a commercial facility, this would cause prolonged downtime which is unaffordable.

Eventually, it was discovered that by substantially lowering the polymer concentration in the solution mixture and by increasing the solution temperature, that stronger fabrics were being made that had better barrier properties while also having better comfort qualities. A particularly interesting discovery during this development process was that lower concentration does not appear to increase elongation until the spin orifice is reconfigured to have a long length to diameter ratio (L/D). At a conventional L/D ratio of about 0.9, virtually no difference in elongation was found. However, when a replacement spin orifice was installed having a longer L/D ratio, the elongation substantially improved with reductions in polymer concentration.

There are a number of properties of Tyvek® fabric and sheet that are measured by DuPont. For purposes of explaining the instant invention, the following tests are presented:

Gurley Hill Porosity is a measure of the barrier strength of the sheet material for gaseous materials. In particular, it is a measure of how long it takes for a volume of gas to pass through an area of material wherein a certain pressure gradient exists.

Gurley-Hill porosity is measured in accordance with TAPPI T-460 om-88, which is hereby incorporated by reference, using a Lorentzen & Wettre Model 121D Densometer. This test measures the time of which 100 cubic centimeters of air is pushed through a one inch diameter sample under a pressure of approximately 4.9 inches of water. The result is expressed in seconds and is usually referred to as Gurley Seconds. ASTM refers to the American Society of Testing Materials and TAPPI refers to the Technical Association of Pulp and Paper Industry.

Elongation to Break of a sheet is a measure of the amount a sheet stretches prior to failure (breaking) in a strip tensile test. A 1.0 inch (2.54 cm) wide sample is mounted in the clamps—set 5.0 inches (12.7 cm) apart—of a constant rate of extension tensile testing machine such as an Instron table model tester. A continuously increasing load is applied to the sample at a crosshead speed of 2.0 in/min (5.08 cm/min) until failure. The measurement is given in percentage of stretch prior to failure. The test generally follows ASTM D 1682-64, which is hereby incorporated by reference. Average elongation to break or average break elongation is the average of the cross directional break elongation and the machine direction break elongation.

Opacity relates to how much light is permitted to pass through a sheet. One of the qualities of Tyvek® sheet is that it is opaque and one cannot see through it. Opacity is the measure of how much light is reflected or the inverse of how much light is permitted to pass through a material. It is measured as a percentage of light reflected. Although opacity measurements are not given in the following data tables, all of the examples have opacity measurements above 90 percent and it is believed that an opacity of at least about 85 is minimally acceptable for almost all end uses.

Hydrostatic Head is a measure of the resistance of the sheet to penetration by liquid water under a static load. A 7×7 in (17.78×17.78 cm) sample is mounted in a SDL 18 Shirley Hydrostatic Head Tester (manufactured by Shirley Developments Limited, Stockport, England). Water is pumped into the piping above the sample at 60+/−3 cm/min until three areas of the sample is penetrated by the water. The measured hydrostatic pressure is measured in inches, converted to SI units and given in centimeters of water. The test generally follows ASTM D 583 (withdrawn from publication November, 1976).

Spencer puncture is measured according to ASTM D-3420-91 Procedure B, which is hereby incorporated by reference, with the exception that an impact head with contact area of 0.35 square inches was used on a modified Elmendorf tester having a capacity of 6400 gram-force. Results are normalized by dividing the measured energy to rupture by the area of the impact head and are reported in in-lbs/in$^2$ (J/cm$^2$). The results below are each based on an average of at least six measurements on the sheet.

EXAMPLES 1–7

Examples 1–7, Tables I and II were formed in the hydrocarbon spin agent system with high density polyethylene, a spin orifice L/D ratio of 5.1 and point bonded with a linen and "P" point pattern at 5515 kPascals (800 psi) on a 34" bonding calendar with steam pressure at 483 kPascals-gauge (70 psig) without mechanical softening.

TABLE I

| | Ex. 1 | Ex. 2 | Ex. 3 | Ex. 4 |
|---|---|---|---|---|
| Spinning Conditions | | | | |
| Concentration (%) | 22 | 18 | 16 | 16 |
| Solution Temp. (°C.) | 175 | 189 | 175 | 185 |
| Physical Properties | | | | |
| Basis Weight (g/m$^2$) | 40.5 | 40.5 | 40.5 | 40.5 |
| Delamination (N/m) | 24.5 | 10.5 | 24.5 | 26.5 |
| Hydrostatic Head (cm) | 79 | 163 | 203 | 201 |
| Tensile Strength MD (N/m) | 1600 | 1950 | 2300 | 1750 |
| Tensile Strength XD (N/m) | 1950 | 2100 | 2650 | 1600 |
| Elongation MD (%) | 14 | 16 | 15 | 17 |
| Elongation XD (%) | 23 | 22 | 20 | 25 |
| Work to Break MD (N-m) | 0.6 | 0.7 | 0.8 | 0.7 |
| Work to Break XD (N-m) | 0.9 | 0.9 | 1.0 | 0.8 |

TABLE II

| | Ex. 5 | Ex. 6 | Ex. 7 |
|---|---|---|---|
| Spinning Conditions | | | |
| Concentration (%) | 14 | 14 | 12 |
| Solution Temp. (°C.) | 175 | 184 | 175 |
| Physical Properties | | | |
| Basis Weight (g/m$^2$) | 44 | 40.5 | 40.5 |
| Delamination (N/m) | 23 | 24.5 | 61.5 |
| Hydrostatic Head (cm) | 175 | 231 | 196 |

TABLE II-continued

| | Ex. 5 | Ex. 6 | Ex. 7 |
|---|---|---|---|
| Tensile Strength MD (N/m) | 1750 | 1950 | 1950 |
| Tensile Strength XD (N/m) | 1950 | 2300 | 2300 |
| Elongation MD (%) | 27 | 23 | 29 |
| Elongation XD (%) | 39 | 37 | 49 |
| Work to Break MD (N-m) | 1.0 | 1.0 | 1.2 |
| Work to Break XD (N-m) | 1.5 | 1.2 | 1.5 |

EXAMPLES 8–14

Examples 8–14, Tables III and IV were formed in the hydrocarbon spin agent system with high density polyethylene, a spin orifice L/D ratio of 5.1 and point bonded with a rib and bar pattern at 5515 kPascals (800 psi) on a 34" bonding calendar with steam pressure at 483 kPascals-gauge (70 psig) without mechanical softening.

TABLE III

| | Ex. 8 | Ex. 9 | Ex. 10 | Ex. 11 |
|---|---|---|---|---|
| Spinning Conditions | | | | |
| Concentration (%) | 22 | 18 | 16 | 16 |
| Solution Temp. (°C.) | 175 | 189 | 175 | 185 |
| Physical Properties | | | | |
| Basis Weight (g/m$^2$) | 40.5 | 40.5 | 40.5 | 40.5 |
| Delamination (N/m) | 23 | 16 | 19 | 24.5 |
| Hydrostatic Head (cm) | 124 | 180 | 229 | 234 |
| Tensile Strength MD (N/m) | 1600 | 1600 | 2106 | 2100 |
| Tensile Strength XD (N/m) | 1750 | 1950 | 2650 | 1950 |
| Elongation MD (%) | 13 | 15 | 12 | 18 |
| Elongation XD (%) | 24 | 24 | 19 | 26 |
| Work to Break MD (N-m) | 0.35 | 0.45 | 0.6 | 0.8 |
| Work to Break XD (N-m) | 0.9 | 0.9 | 1.0 | 1.0 |

TABLE IV

| | Ex. 12 | Ex. 13 | Ex. 14 |
|---|---|---|---|
| Spinning Conditions | | | |
| Concentration (%) | 14 | 14 | 12 |
| Solution Temp. (°C.) | 175 | 184 | 175 |
| Physical Properties | | | |
| Basis Weight (g/m$^2$) | 44 | 40.5 | 40.5 |
| Delamination (N/m) | 37 | 19.5 | 42 |
| Hydrostatic Head (cm) | 175 | 178 | 229 |
| Tensile Strength MD (N/m) | 1950 | 1950 | 1750 |
| Tensile Strength XD (N/m) | 2300 | 2300 | 2100 |
| Flongation MD (%) | 28 | 22 | 29 |
| Elongation XD (%) | 40 | 36 | 52 |
| Work to Break MD (N-m) | 1.2 | 0.8 | 1.1 |
| Work to Break XD (N-m) | 1.8 | 1.2 | 2.1 |

All of the examples above have Opacity measurements above 90 and it is believed that an opacity of at least about 85 is minimally acceptable for almost all end uses.

One particular property to note in the above examples is the elongation of the fabric. Elongation of nearly 50% is quite substantial as indicated in Example 15. Clearly, it is desirable to have substantial elongation percentages so that the fabrics stretch and give before they break or rip. This improvement was obtained by providing the system with an elongated spin orifice 14 in combination with an inline static mixer in the letdown chamber.

The data thus far has been focused on soft structure "point bonded" material. The benefits of the present invention also translate to the hard structure which is fully bonded on both sides of the sheet. Hard structure is unlikely to be used in apparel applications but improvements in elongation and toughness would be appreciated in applications suitable for area bonded flash-spun nonwovens.

EXAMPLES 15–22

Examples 15–22, Tables V and IV were formed in the hydrocarbon spin agent system with high density polyethylene, a spin orifice L/D ration of 5.1 and area bonded using a thermal bonder.

TABLE III

| | Ex. 15 | Ex. 16 | Ex. 17 | Ex. 18 |
|---|---|---|---|---|
| Spinning Conditions | | | | |
| Concentration (%) | 24 | 18 | 18 | 16 |
| Solution Temp. (°C.) | 175 | 175 | 189 | 175 |
| Physical Properties | | | | |
| Basis Weight (g/m$^{2)}$ | 57.5 | 57.5 | 57.5 | 61 |
| Delamination (N/m) | 63 | 54.5 | 63 | 70 |
| Hydrostatic Head (cm) | 102 | 150 | 147 | 216 |
| Tensile Strength (N/m) | 3250 | 4150 | 5050 | 4400 |
| Elongation (%) | 16 | 22 | 26 | 28 |
| Spencer Puncture (in-lb/in$^{2)}$ | 20 | 26 | 28 | 31 |
| Opacity (%) | 96 | 97 | 92 | 97 |

TABLE VI

| | Ex. 19 | Ex. 20 | Ex. 21 | Ex. 22 |
|---|---|---|---|---|
| Spinning Conditions | | | | |
| Concentration (%) | 16 | 14 | 14 | 12 |
| Solution Temp. (°C.) | 185 | 175 | 184 | 175 |
| Physical Properties | | | | |
| Basis Weight (g/m$^{2)}$ | 57.5 | 61 | 57.5 | 57.5 |
| Delamination (N/m) | 63 | 71.8 | 66.5 | 64.8 |
| Hydrostatic Head (cm) | 173 | 218 | 257 | 264 |
| Tensile Strength (N-m/g) | 4750 | 4750 | 4750 | 4750 |
| Elongation (%) | 28 | 35 | 33 | 49 |
| Spencer Puncture (in-lb/in$^2$) | 33 | 28 | 33 | 26 |
| Opacity (%) | 95 | 97 | 96 | 95 |

CONCLUSION

To summarize the foregoing described invention and put it into perspective, the developments described herein will lead to substantially improved products.

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. Clearly, the scope of any patent rights granted on this application should be measured and determined by the claims that follow.

We claim:

1. A flash spun polymeric sheet material having an opacity of greater than 85%, a basis weight greater than 30 g/m$^2$ but less than 100 g/m$^2$, and an average break elongation of greater than about 30%.

2. The sheet material according to claim 1 wherein the sheet material comprises an olefin polymer.

3. The sheet material according to claim 2 wherein the sheet material is high density polyethylene.

4. The sheet material according to claim 1 wherein the average elongation is greater than about 35%.

5. The sheet material according to claim 1 wherein the average elongation is greater than about 40%.

6. The sheet material according to claim 1 wherein the basis weight of the sheet material is less than 85 g/m$^2$.

7. The sheet material according to claim 1 wherein the basis weight of the sheet material is less than 70 g/m$^2$.

8. The sheet material according to claim 1 wherein the sheet material is substantially exclusively nonwoven fibers.

9. The sheet material according to claim 1 wherein the opacity is greater than 90%.

10. The sheet material according to claim 1 wherein the sheet material comprises flash-spun plexifilamentary film-fibrils which have been area bonded.

11. The sheet material according to claim 1 wherein the sheet material is point bonded.

12. The sheet material according to claim 1 wherein the sheet material is comprised of a unitary sheet of point-bonded flash-spun plexifilamentary fibers wherein the bond points are partially broken to be softer.

13. A flash spun polymeric envelope material having an opacity greater than 85%, a basis weight greater than 30 g/m$^2$ but less than 100 g/m$^2$, a Spencer puncture greater than 20 in-lb/in$^2$ and an average break elongation of greater than about 35%.

14. The envelope material according to claim 13 wherein the material comprises an olefin polymer.

15. The envelope material according to claim 14 wherein the material is high density polyethylene.

16. The envelope material according to claim 13 wherein the average elongation is greater tan about 35%.

17. The envelope material according to claim 13 wherein the average elongation is greater than about 40%.

18. The envelope material according to claim 13 wherein the basis weight of the material is less than 85 g/m$^2$.

19. The envelope material according to claim 13 wherein the basis weight of the material is less than 70 g/m$^2$.

20. In a process for flash spinning polymer and forming fabric therefrom, the improvement comprising spinning a polymer solution through a spin orifice having length to diameter ratio of at least 2.0 and an inline mixer in a letdown chamber upstream of the spinning orifice.

21. The process according to claim 20 wherein the length to diameter ratio of the spinning orifice is greater than 3.0.

22. The process according to claim 20 wherein the length to diameter ratio of the spinning orifice is greater than 4.0.

23. In a process for flash spinning polymer and forming sheet material therefrom, the improvement comprising mixing the polymer in a pentane spin agent at a ratio of less than about 16% polymer, and emitting the polymer solution through a spin orifice at a temperature of at least about 180° C., wherein the spin orifice has a length to diameter ratio of at least 2.0.

24. The process according to claim 23 wherein the improvement further comprises spinning polymer through a spin orifice having a length to diameter ration of greater than 3.5.

25. The process according to claim 24 further including a static mixer in the letdown chamber.

* * * * *